73-151 SR
6/29/76 OR 3,965,736

United States Patent [19]
Welton et al.

[11] 3,965,736
[45] June 29, 1976

[54] CLAMP-ON TRANSDUCER FOR WELL UNIT

[75] Inventors: Barry S. Welton; G. Wayne Westerman, both of Midland, Tex.

[73] Assignee: Energy Systems, Inc., Midland, Tex.

[22] Filed: Feb. 13, 1974

[21] Appl. No.: 442,218

[52] U.S. Cl. ..... 73/151
[51] Int. Cl.[2] ..... E21B 47/00
[58] Field of Search ..... 73/151, 88.5 R, 141 A, 73/95; 338/5, 6; 33/147 D, 148 D

[56] References Cited

UNITED STATES PATENTS

| | | | |
|---|---|---|---|
| 2,392,293 | 1/1946 | Ruge | 73/136 A |
| 2,677,272 | 5/1954 | Blancher | 73/151 |
| 3,765,234 | 10/1973 | Sievert | 73/151 |
| 3,791,205 | 2/1974 | Hooker | 73/88.5 R |

*Primary Examiner*—Jerry W. Myracle
*Attorney, Agent, or Firm*—Wofford, Felsman, Fails & Zobal

[57] ABSTRACT

Strain measuring devices for measuring the strain in the polish rod of a rod-pumped well unit. The devices include a body member to which strain gages are bonded, and further include clamp means for detachably affixing the devices directly to a polish rod. Embodiments are disclosed in which the body member is in the form of a strap, in the form of a split cylinder, or as an elongated bar with a section of reduced cross-section.

9 Claims, 9 Drawing Figures

CLAMP-ON TRANSDUCER FOR WELL UNIT

BACKGROUND OF THE INVENTION

1. Field of the Invention

This invention relates to devices for measuring strain in the polish rod of a rod-pumped well unit, thus giving an indication of the load on the rod string, and more particularly relates to devices which are removably attachable directly to the polish rod of a well unit for monitoring and/or controlling the operation of the well unit.

In rod-pumped well units of the type commonly used to produce oil from a subterranean formation, which units conventionally include a downhole pump attached to a reciprocal rod string extending to the surface, and which include a prime mover for driving a walking beam or the like, the rod string normally includes an upper section designated the "polish rod", which is connected to the walking beam by a clamp and bridle arrangement, all as is well known. In the operation of such well units, it is frequently desirable to utilize means to monitor and/or control the operation of the unit to maximize the efficiency thereof and to prevent equipment damage in the event of equipment malfunction or of reaching a "pumped-off" condition in the well.

2. Description of the Prior Art

The control of rod-pumped well units, prior to this invention, has been accomplished utilizing transducers positioned between a hangar bar and a clamp on the polish rod. These transducers may be strain gages bonded to compression blocks, exemplified by U.S. Pat. Nos. 3,343,409; 3,355,938; 3,457,781 and 3,527,094, or hydraulic transmitters as exemplified by U.S. Pat. Nos. 3,306,210 and 3,359,791. Alternatively, control of rod-pumped wells has heretofore been accomplished utilizing motor current transducers as exemplified by U.S. Pat. Nos. 3,440,512 and 3,610,779.

More recently, control of rod-pumped well units has been accomplished utilizing a strain gage transducer welded to the top flange of the walking beam of the unit.

All of the above prior art systems have been successful to varying degrees, but they are all subject to certain disadvantages and inconveniences. For example, the last-mentioned system using a strain gage transducer welded to the walking beam is a permanent installation which ties up the transducer substantially permanently. The motor current transducers give an indirect indication of actual conditions in the rod string, since they are not directly connected thereto. The transducers positioned between the hangar bar and the polish rod clamp, whether strain gages or hydraulic transmitters, require considerable mechanical effort for installation, including removing the weight of the rod string from the hangar bar. Additionally, these transducers positioned between the hangar bar and the polish rod clam in effect "weigh" the rod string, rather than measuring actual strain in the rod string. It has been found that a direct measurement of strain in the rod string is preferable to the indirect measurements obtained by prior art systems of controlling well units. Further, the direct measurement devices of this invention are much more convenient to install than prior art devices and can be removed and used on different wells with a minimum of effort.

Thus, it is apparent that there has long been a need for a measuring device for rod-pumped well units which is simple, easy to install and remove, and which provides a direct measurement of the strain in the rod string.

SUMMARY OF THE INVENTION

According to the present invention, strain measuring devices are provided which may be clamped to the polish rod of a well unit and utilized to provide information about or control of the well operation. The devices provide a measurement of the strain on the polish rod.

The devices generally are comprised of three main components, these being a body member, strain gage means bonded to the body member, and clamp means for removably securing the devices to polish rods.

It is a feature of these devices that they may be easily attached to and removed from a well unit polish rod without releasing the rod string from the hangar bar of the well unit. The devices provide an electrical signal indicative of strain in the polish rod, which signal may be input to a conventional monitor or control system.

It is accordingly an object of the present invention to provide improved strain measuring devices for use in measuring the strain of the polish rod of a well unit.

It is a further object to provide such devices which directly measure the strain of the polish rod.

It is a still further object to provide such devices which are easily attached to and removed from a polish rod, and which are usable on polish rods of different diameter.

DESCRIPTION OF THE PREFERRED EMBODIMENTS

Three preferred embodiments of the present invention are described below. Each of these embodiments represents a variation of the central theme of the invention wherein a body member is provided with clamping means and strain gage means such that it can be easily attached to and removed from the polish rod of a well unit.

As noted herein and as further exemplified by the prior art mentioned earlier, it is frequently desirable to control a pumping well in such a manner as to cause shutoff when the well reaches a "pumped off" condition. Previous control systems providing this capability have relied on motor current transducers or "doughnut" transducers for generating a signal indicative of the operating condition of the well unit. A detailed explanation of the reasons for needing such a signal is not considered necessary, as the control systems themselves do not form a part of this invention, and are well understood by those skilled in the art.

To facilitate an understanding of the present invention, a typical well unit on which the devices would be used will be briefly described.

Figure 1:
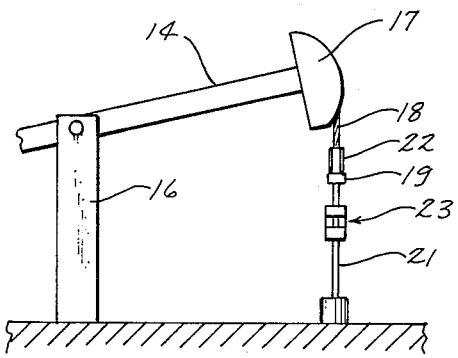
FIG. 1 is a side elevational view of part of a well pumping unit and showing a device according to this invention attached thereto.

A well unit is shown in FIG. 1. Typically, such units include a prime mover (not shown) which drives a crank arm by the output of a gear box. The crank arm carries a counterweight and oscillates a walking beam 14. The walking beam 14 is pivotally mounted to supporting post 16 and has a horsehead 17 at one end. A flexible cable 18 extends from the horsehead 17 to hangar bar 19 which supports the rod string (not shown) including a polish rod section 21 by virtue of polish rod clamp 22. The rod string supports a downhole pump (not shown) in a conventional manner. The equipment as described so far is entirely conventional, and does not constitute a part of the invention.

As previously mentioned, earlier systems for controlling rod-pumped wells utilize motor current transducers in some instances, and "doughnut" transducers positioned between the hangar bar and the polish rod clamp in other instances.

The present invention provides for a more direct measurement of the strain in the rod string by directly measuring strain in the polish rod, and additionally can be affixed to and removed from the polish rod with a minimum of effort compared to the work involved in installing a "doughnut" transducer.

Referring again to FIG. 1, a strain measuring device shown generally at 23 is affixed to polish rod 21 below hangar bar 19, such that the portion of the polish rod subjected to measurement is supporting the entire weight of the rod string, well pump, and fluid column. The strain measuring device 23 includes strain gage means 24 (FIG. 2), which provide a signal that varies with the strain on the polish rod. This signal is fed into a control unit (not shown) which may be at the well site or remotely located, and the control unit receives the signal from the measuring device 23 and processes same according to known technology. For example, the control unit may shut the motor off if the signal indicates a "pumped-off" condition. The control unit and its function likewise do not constitute a part of this invention except insofar as they are necessary to utilize the signal from measuring device 23. The output from strain measuring device 23 can be used as input to a control system, or it can be utilized to produce a graphic representation of the well condition or as input to a computer well analysis program.

The polish rod 21 in a rod-pumped well unit is subjected to tensile stress imposed by the rod string. Hook's law states that strain is proportional to stress. Therefore, the strain imposed on the polish rod is proportional to the tensile loading on the polish rod, and $Sy = P/A$ where $Sy$ is the axial stress, $P$ is the axial load, and $A$ is the cross-sectional area. Further, $\epsilon = Sy/E$ where $\epsilon$ is the unit elongation and $E$ is the modulus of elasticity. Thus, $\epsilon = P/AE$ and $P = AE\,\epsilon$. Since $A$ and $E$ are constant, $\epsilon$ (unit elongation) is directly proportional to $P$ (axial load). Furthermore, a change in transverse dimension occurs due to axial stresses. The magnitude of this change is expressed by Poisson's ratio which states that $\mu = (-y)/\epsilon_x = (-\epsilon_z)/\epsilon_x$ where $\mu$ is Poisson's ratio, $\epsilon_x$ is stress in direction of strain, and $\epsilon_y$ and $\epsilon_z$ are perpendicular strain.

Therefore, a measurement of the longitudinal or the transverse strain in the polish rod is directly proportional to the load on the polish rod. The strain measuring devices described below make use of strain gage elements to measure the strain level in the polish rod, thereby providing a signal which may be utilized by a control system, a well analysis program, or graphical recorder.

Figure 2:
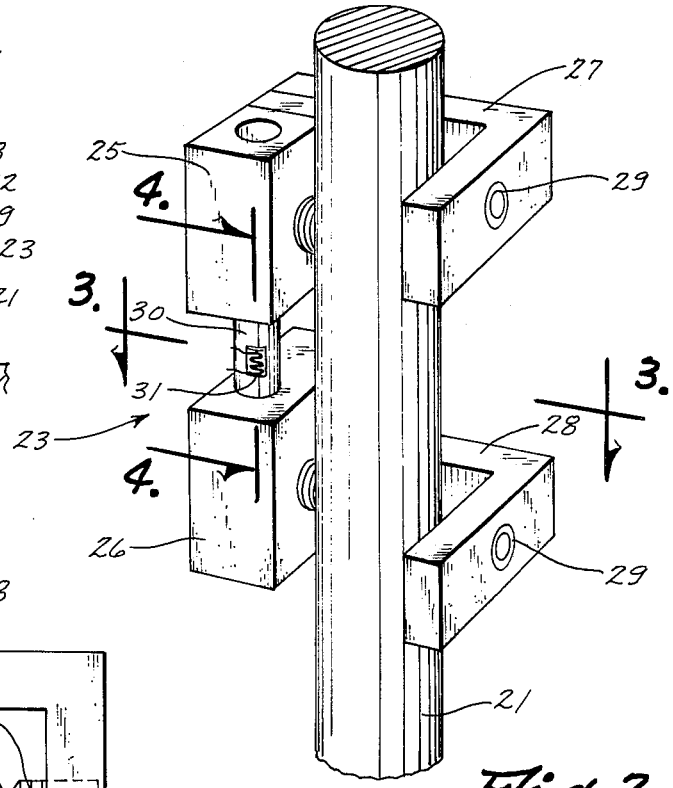
FIG. 2 is a perspective view of one embodiment of the invention attached to the polish rod of a well unit.
Figure 3:
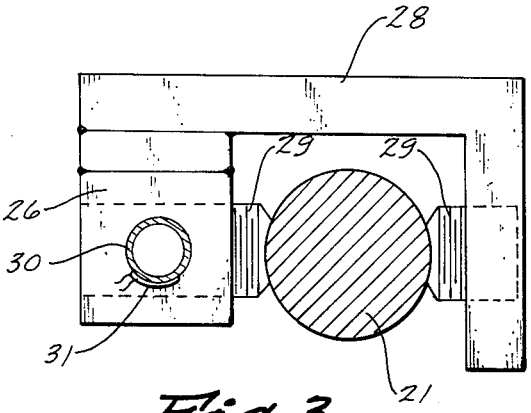
FIG. 3 is a cross-section taken along line 3—3 of FIG. 2.
Figure 4:
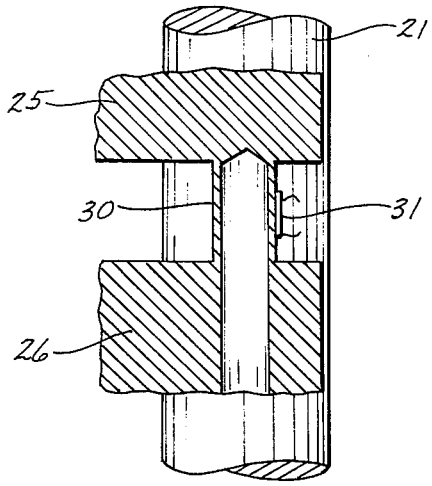
FIG. 4 is a broken cross-section taken along line 4—4 of FIG. 2.

One preferred embodiment of a strain measuring device in accordance with the invention is shown in FIGS. 2–4. As shown therein, the device includes an upper body section 25 and a lower body section 26. Attached to and extending from each of the upper and lower body sections are L-shaped means 27 and 28, respectively. As best seen in FIGS. 2 and 3, large set screws 29 are provided in each of the elements 25, 26, 27 and 28. These set screws 29 hold the device firmly to polish rod 21. Extending between upper body section 25 and lower body section 26 is a central body section 30. This central body section 30 is of reduced cross-section compared to the upper and lower sections (See FIG. 4). Also as seen in FIG. 4, the central body section preferably is bored out to provide a relatively thin-walled section. Thus, it will be apparent that elongation of polish rod 21, when upper and lower L-shaped sections 27 and 28 are clamped thereto, will cause corresponding elongation in central body section 30. A strain gage means 31 is shown bonded to central body section 30, and any change in length of the central body section 30 (caused by change in length of polish rod 21) will be reflected by a change in signal from strain gage means 31 in a manner well known in the art.

Several obvious modifications to the device as shown in FIGS. 2–4 could be made without materially changing its function. For example, the set screws extending from the upper and lower body sections to the polish rod could be replaced with other holding means such as toothed members or the like, and the L-shaped members could obviously be modified in shape without affecting their function.

Referring back to FIG. 1, it is seen that strain measuring device 23 is positioned below the polish rod clamp 22 and hangar bar 19, such that it can be attached and removed without having to remove the weight of the rod string from polish rod clamp 22.

Figure 5:
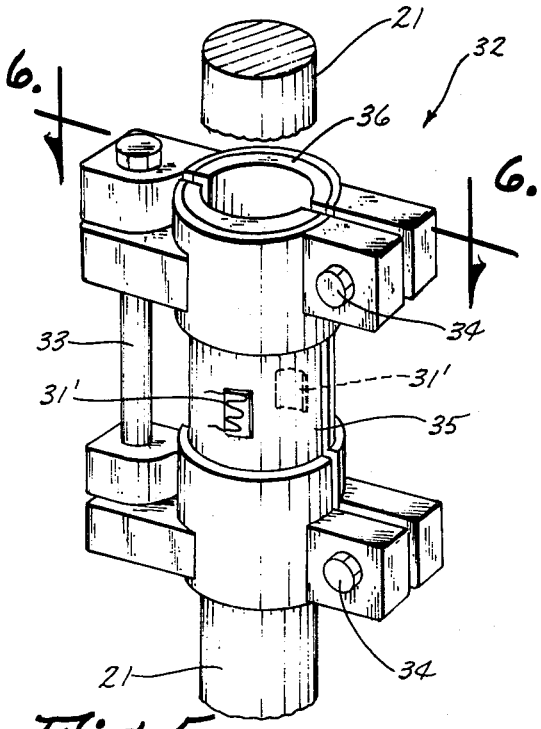
FIG. 5 is a perspective view of a split-ring embodiment of the invention.
Figure 6:
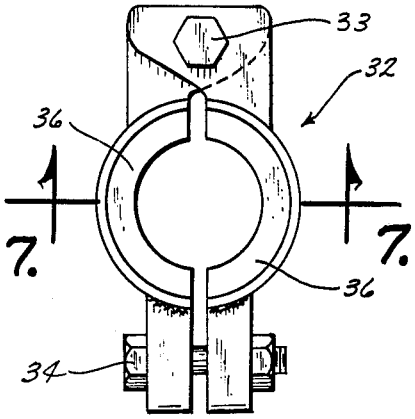
FIG. 6 is a cross-section taken along the line 6—6 of FIG. 5.
Figure 8:
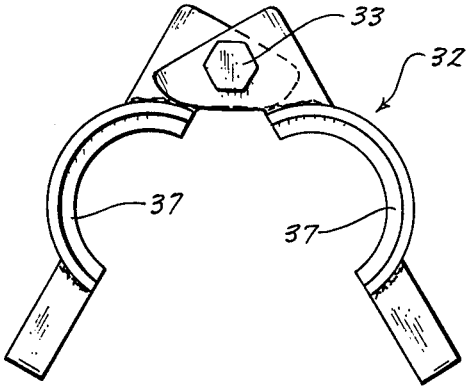
FIG. 8 is a plan view showing the split-ring embodiment in the open position.
Figure 7:
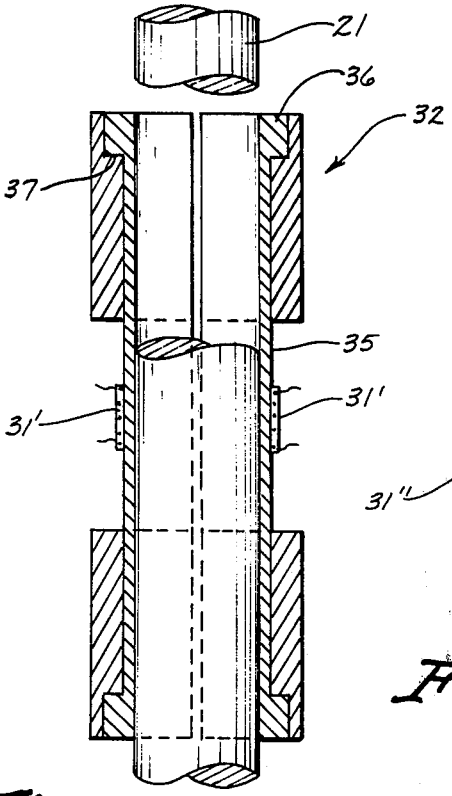
FIG. 7 is a cross-section taken along the line 7—7 of FIG. 6.

A split-ring version of a device in accordance with the invention is illustrated in FIGS. 5–8 and shown generally at 32. This version includes upper and lower half members each pivotally attached to a hinge pin 33. These half members can be opened as shown in FIG. 8 and then closed about polish rod 21 as seen in FIGS. 5 and 6. The upper and lower half members can then be clamped about polish rod 21 by tightening of fasteners 34 extending therethrough. A thin-walled insert 35 (FIG. 7) is carried by each half of the device, and has an enlarged upper and lower section providing a lip 36 for seating in shoulders 37 formed in the upper and lower half members as best seen in FIG. 7. It will be appreciated that different sized inserts could be utilized to accommodate different sized polish rods. The inserts 35 have strain gage means 31′ bonded thereto, and the operation of this device is essentially the same as for the device shown in FIGS. 2–4. Again, it is pointed out that this device can be attached to and removed from a polish rod without having to release the polish rod clamp supporting the rod string.

Figure 9:
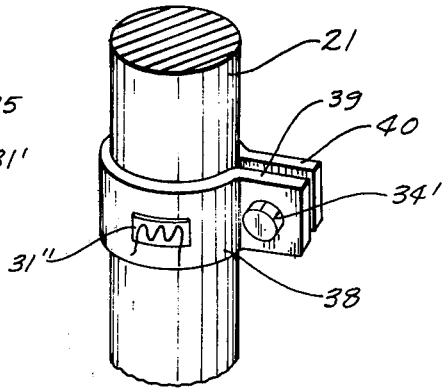
FIG. 9 is a perspective view showing a spring strap embodiment of the invention.

Still another embodiment of the invention is illustrated in FIG. 9. In this embodiment, a flexible ring 38, for example made of spring steel, includes end sections 39, 40 extending outwardly and clampable to polish rod 21 by means of fastener 34' extending through end sections 39 and 40. Strain gage means 31'' bonded to ring 38 provides a measurement of deformation in polish rod 21.

Other variations and modifications could be made without departing from the true scope of the invention. Stated in its broadest form, the invention is directed to devices capable of being releasably attached to a polish rod without the necessity of releasing the polish rod clamp supporting the rod string, which devices include strain gauge measuring units for indicating deformation in the rod string to which they are attached.

The specific embodiments illustrated and described in detail are exemplary of devices encompassed by the invention, which is defined by the appended claims.

We claim:

1. A strain measuring device for measuring the strain in the polish rod of a rod-pumped well unit having a reciprocal rod string extending to a subterranean producing formation and actuated by a prime mover comprising:

body means;

clamp means coupled to the body means, the clamp means being capable of detachably affixing the body means to the exterior of the polish rod of a well unit; and transducer means attached to the body means and adapted to provide an indication of the strain induced in the polish rod during reciprocation thereof, said body means comprising a split cylinder, and hinge pin means joining sections of said split cylinder, said clamp means being adapted to hold said split cylinder about a portion of the polish rod.

2. The device of claim 1 including inserts in the sections of the split cylinder enabling same to be fitted about a polish rod having a diameter smaller than the inner diameter of the split cylinder.

3. A strain measuring device for measuring the strain in the polish rod of a rod-pumped well unit having a reciprocal rod string extending to a subterranean producing formation and actuated by a prime mover, comprising:

two generally half cylindrical members adapted to be fitted around the exterior of the polish rod of a well unit, each generally half cylindrical member having first and second end portions generally diametrically opposite each other, transducer means coupled to at least one of said two generally half cylindrical members and adapted to provide an indication of the strain induced in the polish rod during reciprocation thereof, means coupled to said first end portions of said two generally half cylindrical members to allow said second end portions of said two generally half cylindrical members to move toward and away from each other to closed and open positions, and means for securing said second end portions of said two generally half cylindrical members relative to each other when in said closed position and when said two generally half cylindrical members are fitted around polish rod to allow said two generally half cylindrical members to be clamped around the polish rod.

4. The strain measuring device of claim 3 wherein:

said transducer means is coupled to the exterior side portion of said one generally half cylindrical member.

5. A strain measuring device for measuring the strain in the polish rod of a rod-pumped well unit having a reciprocal rod string extending to a subterranean producing formation and actuated by a prime mover, comprising:

two arcuate members adapted to be fitted around the exterior of the polish rod of a well unit, each arcuate member having first and second end portions adapted to be located generally on opposite sides of the polish rod, transducer means coupled to the exterior side of at least one of said arcuate members to provide an indication of the strain induced in the polish rod during reciprocation thereof, means coupled to said first end portions of said two arcuate members to allow said second end portions of said two arcuate members to move toward and away from each other to closed and open positions, and means for securing said second end portions of said arcuate members relative to each other when in said closed position and when said two arcuate members are fitted around the polish rod to allow said two arcuate members to be clamped around the polish rod.

6. A strain measuring device for measuring the strain in the polish rod of a rod-pumped well unit having a reciprocal rod string extending to a subterranean producing formation and actuated by a prime mover comprising:

two generally half cylindrical members adapted to be fitted around the exterior of the polish rod of a well unit, spaced apart hinge means coupled to opposite ends of said two generally half cylindrical members at spaced apart positions along their lengths to allow said two generally half cylindrical members to move to open and closed positions, spaced apart fastening means coupled to said opposite ends of said two generally half cylindrical members at spaced apart positions along their lengths for removably securing said two generally half cylindrical members around the exterior of the polish rod, and transducer means attached to the exterior side portion of each of said generally half cylindrical members at a position located between said opposite ends of each of said generally half cylindrical members to provide an indication of the strain induced in the polish rod during reciprocation thereof.

7. A strain measuring device for measuring the strain in the polish rod of a rod-pumped well unit having a reciprocal rod string extending to a subterranean production formation and actuated by a prime mover, comprising:

body means;

clamp means coupled to said body means, said clamp means being capable of detachably affixing said body means to the exterior of the polish rod of a well unit; and transducer means attached to said body means and adapted to provide an indication of the strain induced in the polish rod during reciprocation thereof, said clamp means comprising spaced apart upper and lower portions capable of being fitted at least partially around and removed from the polish rod transversely of its elongated axis for removably affixing said body means to the polish rod at two spaced apart positions along the length of the polish rod, each of said upper and lower portions of said clamp means comprising two half members having their ends coupled together with hinge means, said body means comprising two generally half cylindrical members adapted to be fitted around the polish rod, each generally half cylindrical member having upper and lower ends coupled to a half member of each of said upper and lower portions of said clamp means respectfully, said transducer means comprising a transducer attached to each of said generally half cylindrical members between said spaced apart upper and lower portions of said clamp means.

8. The device of claim 7 wherein: said transducers are attached to the exterior of said generally half cylindrical members.

9. The device of claim 7 wherein: said transducers comprise strain gage means bonded to the exterior of said generally half cylindrical members.

* * * * *